US011711642B2

(12) United States Patent
Hosaka

(10) Patent No.: US 11,711,642 B2
(45) Date of Patent: Jul. 25, 2023

(54) EARPHONES

(71) Applicant: MOVE COMPANY LIMITED, Tokyo (JP)

(72) Inventor: Akihiko Hosaka, Tokyo (JP)

(73) Assignee: MOVE COMPANY LIMITED, Tokyo (JP)

( * ) Notice: Subject to any disclaimer, the term of this patent is extended or adjusted under 35 U.S.C. 154(b) by 255 days.

(21) Appl. No.: 17/288,912

(22) PCT Filed: Oct. 28, 2018

(86) PCT No.: PCT/JP2018/040007
§ 371 (c)(1),
(2) Date: Apr. 26, 2021

(87) PCT Pub. No.: WO2020/089956
PCT Pub. Date: May 7, 2020

(65) Prior Publication Data

US 2021/0400369 A1 Dec. 23, 2021

(51) Int. Cl.
*H04R 1/10* (2006.01)
*H04R 1/20* (2006.01)

(52) U.S. Cl.
CPC ..... *H04R 1/1016* (2013.01); *H04R 1/1075* (2013.01); *H04R 1/20* (2013.01)

(58) Field of Classification Search
CPC ..... H04R 1/1016; H04R 1/1075; H04R 1/20; H04R 2460/11
See application file for complete search history.

(56) References Cited

U.S. PATENT DOCUMENTS

2009/0041284 A1* 2/2009 Tanaka ..... H04R 1/1016 381/370
2010/0322453 A1* 12/2010 Matsuyama ..... H04R 1/2857 381/380

FOREIGN PATENT DOCUMENTS

| | | | |
|---|---|---|---|
| JP | 200332772 | A | 1/2003 |
| JP | 200944429 | A | 2/2009 |
| JP | 20119909 | A | 1/2011 |
| JP | 2011155331 | A | 8/2011 |
| JP | 201576856 | A | 4/2015 |
| JP | 201582824 | A | 4/2015 |
| JP | 2016195469 | A | 11/2016 |
| JP | 6429415 | B2 | 11/2018 |

* cited by examiner

*Primary Examiner* — Brian Ensey
(74) *Attorney, Agent, or Firm* — Hauptman Ham, LLP

(57) ABSTRACT

An earphone including a speaker that outputs sounds to a uniaxial direction; a sound guide tube offset from a center of the speaker to and disposed on one side of a direction orthogonal to the uniaxial direction, the sound guide tube extending to a direction parallel to the uniaxial direction; and a housing accommodating the speaker and supporting a base end of the sound guide tube, wherein the housing is broadened from the base end to other side opposite to the one side, toward a location where the speaker is accommodated, and has an inclined surface that inclines at the broadened location, and a separation distance between a central axis of the speaker and a central axis of the sound guide tube is smaller than an internal radius of the sound guide tube.

5 Claims, 2 Drawing Sheets

EARPHONES

RELATED APPLICATIONS

The present application is a National Phase of International Application Number PCT/JP2018/040007, filed Oct. 28, 2018.

TECHNICAL FIELD

The present invention relates to earphones.

BACKGROUND ART

Earphones are audio equipment to be used by placing a housing into the ear (cavum conchae), the housing configured to accommodate a speaker, and inserting a sound guide tube into an external acoustic opening, the sound guide tube configured to transmit sounds emitted by the speaker (See Patent Literature 1, for example). An ear has a recess, which is referred to as the cavum conchae, between the tragus on a front side (side facing a facial surface) and the antitragus (and the antihelix) on a back side (side facing a back of the head). The external acoustic opening extends frontwards at an angle of approximately 60 degrees to an inner surface of the cavum conchae, from a position proximate to the tragus in the cavum conchae deeply thereinto (See FIGS. 1A and 1B).

To achieve low-frequency characteristics with good sounds, a large speaker having an outside diameter of 13 mm or larger, for example, is necessary. To achieve good high-frequency characteristics, it is necessary to place the sound guide tube proximate to the speaker and transmit to the sound guide tube sounds emitted from the speaker without the sounds being reflected within the housing.

However, the external acoustic opening is proximate to the tragus and the tragus projects to a side opposite to the drum membrane with respect to the external acoustic opening. Thus, if a configuration is such that the housing is placed in the cavum conchae without interference with the tragus and the sound guide tube is inserted into the external acoustic opening (see Patent Literature 1, for example), an axial direction of the sound guide tube has an angle to a sound-emitting direction of the speaker. More specifically, the sounds are reflected within the housing, degrading the high-frequency characteristics.

To dispose the speaker with the axial direction of the sound guide tube aligned with the sound-emitting direction of the speaker, there is a problem: if the configuration is such that speaker is small to circumvent the tragus, for example, the low-frequency characteristics degrade. In contrast, if the configuration is such that a large speaker is disposed in front of the tragus, the speaker is spaced from the sound guide tube, degrading the high-frequency characteristics (See FIGS. 2A-2C).

CITATION LIST

Patent Literature

PTL 1: Japanese Unexamined Patent Application Publication No. 2016-195469

SUMMARY OF THE INVENTION

Problems to be Solved by the Invention

The present invention is to provide earphones with good sound quality by placing a large speaker close to a sound guide tube, with an axial direction of the sound guide tube aligned with a sound-emitting direction of the speaker.

Means for Solving the Problems

First, description is given of a shape of the ear that causes the problem. FIGS. 1A and 1B are diagrams illustrating the ear. FIG. 1A is a diagram of the ear when seen from a lateral side. The ear 7 has the tragus 7*a*, the cavum conchae 7*b*, and the scapha 7*c*, and an external acoustic opening 8 reaches the drum membrane. More specifically, an earphone 1 is used by inserting a sound guide tube 3 into the external acoustic opening 8.

FIG. 1B is a cross-sectional diagram at a dashed-dotted line of FIG. 1A. The tragus 7*a* projects and makes it difficult to dispose the earphone 1 close to the external acoustic opening 8 when a housing 2 is large. Although the scapha 7*c* also projects, presence of the cavum conchae 7*b* between the external acoustic opening 8 and the scapha 7 makes it possible to place the large housing 2 in contact with the cavum conchae 7*b*. The cavum conchae 7*b* has an approximately planar shape and inclines to a surface perpendicular to an axis of the external acoustic opening 8 by θ, where θ≈30 degrees.

FIGS. 2A-2C are diagrams illustrating a contrast between an earphone of the prior art and an earphone of the present invention. FIG. 2A illustrates the earphone configured so that a large speaker is disposed in front of the tragus. A speaker 4 is spaced from the sound guide tube 3, degrading high-frequency characteristics. FIG. 2B illustrates the earphone configured so that the housing 2 is placed in the cavum conchae without interference with the tragus. An axial direction of the sound guide tube 3 has an angle of θ to the sound-emitting direction of the speaker 4, degrading the high-frequency characteristics.

FIG. 2C illustrates the earphone of the present invention. The housing 2 has a bilaterally asymmetric shape. The housing 2 is broadened to side of the cavum conchae 7*b* and has an inclined surface 2*b*. The present invention solves the problem with the housing having such a shape.

An earphone of the present invention includes:

a speaker that outputs sounds to a uniaxial direction;

a sound guide tube that is offset from a center of the speaker to and disposed on one side of directions orthogonal to the uniaxial direction, the sound guide tube extending to a direction parallel to the uniaxial direction; and a housing that accommodates the speaker and supports a base end of the sound guide tube, wherein the earphone is characterized in that the housing is broadened from the base end to other side opposite to the one side, toward a location where the speaker is accommodated, and has an inclined surface that inclines at the broadened location, and a separation distance between a central axis of the speaker and a central axis of the sound guide tube is smaller than an internal radius of the sound guide tube.

According to this characteristic, it is possible for the broadened housing to accommodate a large speaker. It is possible to dispose the speaker with the axial direction of the sound guide tube aligned with the sound-emitting direction of the speaker.

The earphone of the present invention is characterized in that:

the inclined surface inclines at an angle of 25 to 35 degrees to the uniaxial direction, to a direction toward the other side, of the orthogonal directions, and is formed in a recessed shape.

According to this characteristic, it is possible to provide the earphone that gives fit when the earphone is worn on the ear, with the inclined surface abutting an inner surface of the cavum conchae, and that has good sound quality.

The earphone of the present invention is characterized in that:

the housing has an oval shape with a direction orthogonal to the uniaxial direction as a long axis direction when it is seen from one side to other side of the uniaxial direction.

According to this characteristic, it is possible to conduct sounds outputted from the speaker to the uniaxial direction directly through the sound guide tube without causing the sounds being reflected in the housing. Therefore, it is possible to achieve the high sound quality.

The earphone of the present invention is characterized in that:

at least one of the housing or the sound guide tube has a vent hole on side of the sound guide tube rather than on the speaker.

According to this characteristic, air entering or leaving via the vent hole makes it possible to match air pressure in a section extending from the speaker to the external acoustic opening to outside air pressure. This is to adjust a change in the sound quality based on a difference between the air pressure in the sound guide tube and the outside air pressure that is in contact with the drum membrane.

The earphone of the present invention is characterized in that:

the earphone further includes a valve that opens or closes the vent hole and an elastic member that adjusts opening or closing of the valve.

According to this characteristic, it is possible to adjust the air pressure in the section extending from the speaker to the external acoustic opening according to user's preference, by opening or closing the valve by means of the elastic member.

Effect of the Invention

According to the present invention, it is possible to provide earphones with good sound quality by placing a large speaker close to a sound guide tube, with an axial direction of the sound guide tube aligned with a sound-emitting direction of the speaker.

MODES FOR CARRYING OUT THE INVENTION

In the following, description is given of an example of the present invention.

Figure 3A:
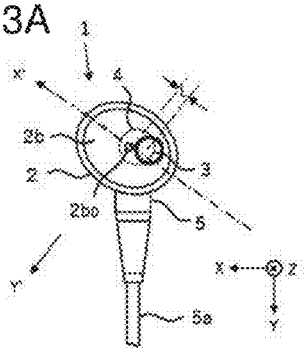
FIG. 3A, FIG. 3B and FIG. 3C are diagrams illustrating a configuration of the earphone.
Figure 3B:
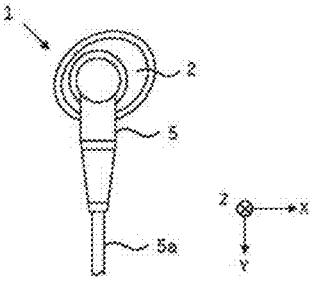
Figure 3C:
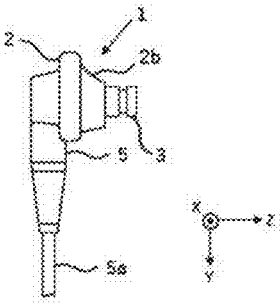

FIGS. 3A-3C are diagrams illustrating a configuration of an earphone. FIG. 3A is a diagram of an earphone 1 when seen from side of an external acoustic opening 8. FIG. 3B is a diagram illustrating the earphone 1 when seen from side opposite to the external acoustic opening 8. FIG. 3C is a diagram illustrating the earphone 1 when seen from a direction perpendicular to FIG. 3A and FIG. 3B. An axial direction of a sound guide tube 3 is a Z-axis direction. A direction of a cord that communicates an external signal is a Y-axis direction, and a direction perpendicular to the Z-axis direction and the Y-axis direction is an X-axis direction.

The earphone 1 is an earphone for the left ear and includes a housing 2, the sound guide tube 3, a speaker 4, and a cord holder unit 5. It is to be noted that the earphone for the right ear has a shape symmetrical to the earphone 1 in the X-axis direction.

The housing 2 is a casing that accommodates the speaker 4 and has a main body and a head. It is possible to mold the main body and the head, including the sound guide tube 3, integrally from a same material as that of the sound guide tube 3.

The sound guide tube 3 is a tubular member that transmits sounds outputted from the speaker 4. The sound guide tube 3 is molded into a cylindrical shape by means of a thermoplastic resin, for example, the cylindrical shape being centered around a central axis 3L. An internal radius of a hollow part is equal to or larger than 3 mm, for example. With the central axis 3L directed parallel to the Z-axis direction, the sound guide tube 3 is disposed on one side (−X' side) of a direction (X'-axis to be described below) orthogonal to the Z-axis direction from a central axis 4L of the speaker 4 on +Z side of the speaker 4. Here, a separation distance L between the central axis 4L of the speaker 4 and the central axis 3L of the sound guide tube 3 is smaller than the internal radius of the sound guide tube 3 (more specifically, less than 3 mm). This makes it possible to conduct sounds outputted from the speaker 4 to the Z-axis direction, through the sound guide tube 3, without the sounds being reflected or with less reflection in a hollow part 2*a* of the housing 2.

It is to be noted that the earpiece molded from silicon rubber or the like may be provided at a tip of the sound guide tube 3. With this, when the sound guide tube 3 is inserted into the external acoustic opening, the earpiece deforms and fits into the opening, thus making it possible to support the sound guide tube 3 while keeping the interior of the external acoustic opening airtight.

Figure 1A:
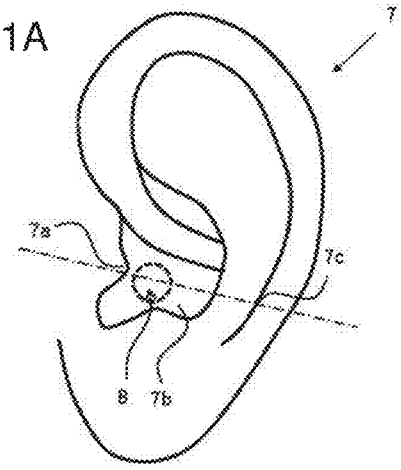
FIG. 1A and FIG. 1B are diagrams illustrating the ear.
Figure 1B:
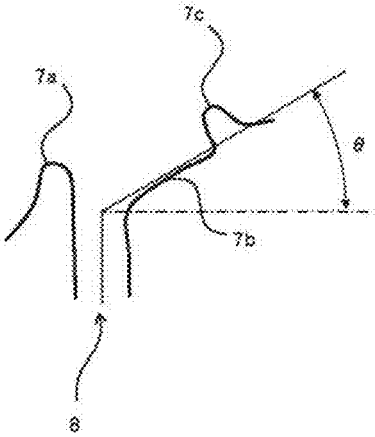
Figure 2A:
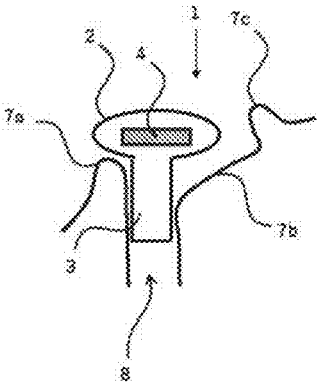
FIG. 2A, FIG. 2B and FIG. 2C are diagrams illustrating a contrast between an earphone of the prior art and an earphone of the present invention.
Figure 2B:
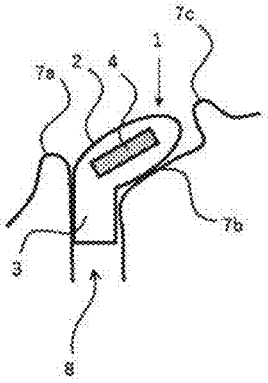
Figure 2C:
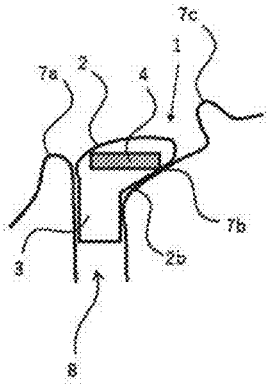

The speaker 4 is a device that outputs sounds. A large speaker having an outside diameter of 13 mm or larger is adopted so as to output sounds with good low-frequency characteristics. The speaker 4 includes, for example, a voice coil, a diaphragm, and a driver (all of which are not illustrated). The speaker 4 emits sounds along the central axis 4 parallel to the Z-axis that passes through a center of the speaker 4 (more specifically, the diaphragm), by controlling the voice coil according to an electric signal inputted externally, and causing the diaphragm facing a uniaxial direction (here, the Z-axis direction) to vibrate (see FIG. 2A). It is to be noted that molding the center of the diaphragm in a dome shape with the outside diameter of 8 mm, for example, makes it possible to output good sounds also for medium- and high-frequency characteristics.

The cord holder unit 5 is a member that holds a cord 5*a* connected to the speaker 4. The cord holder unit 5 extends from a lower surface of the head of the housing 2 to a +Y direction and sends out the cord 5*a* from a tip thereof. It is to be noted that a plug (not illustrated) is provided at the tip of the cord 5*a*, the plug being inserted into a jack of audio equipment such as a CD player, or the like.

In the following, description is given of the housing 2 in detail.

The main body has an oval shape in a front view (when seen from a −Z direction). A direction in which the oval shape inclines to the X-axis direction (which is an X'-axis direction) is a long axis direction. It is to be noted that a direction perpendicular to the X'-axis direction in an X-Y plane is a Y'-axis direction.

Figure 4:
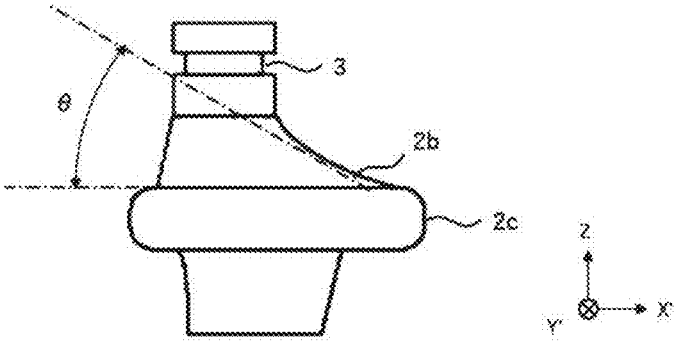
FIG. 4 is a diagram illustrating an inclined surface of a housing.

FIG. 4 is a diagram illustrating an inclined surface of the housing. FIG. 4 is a diagram seen from a −Y' direction in FIG. 3A and has a lower part of the cord holder unit 5 omitted. On an outer surface, the main body has an inclined surface 2*b* that inclines from a base end of the sound guide tube 3. Here, the inclined surface 2*b* inclines at an angle of, for example, 25 to 35 degrees, preferably at an angle of approximately 30 degrees to the X'-axis direction. With this, when the earphone 1 is worn on the ear, the inclined surface 2*b* abuts the inner surface of the cavum conchae and it is possible to direct the sound guide tube 3 toward the external acoustic opening and insert the sound guide tube 3 thereinto.

A head 2*c* is erected on a surface on side opposite to the sound guide tube 3 of the main body and has the cord holder unit 5 is connected.

Figure 5:
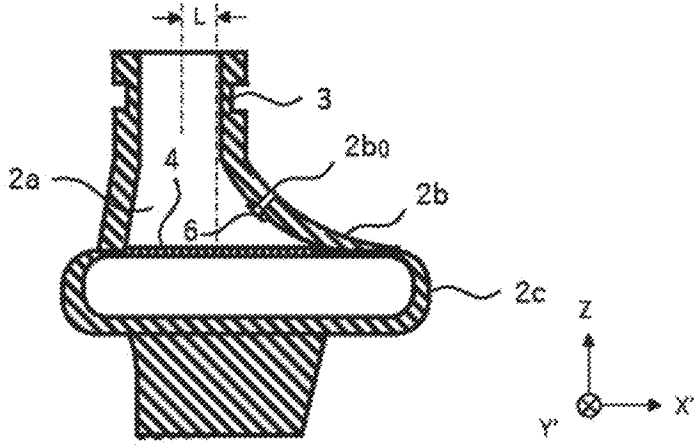
FIG. 5 is a diagram illustrating an internal configuration of the housing.

FIG. 5 is a diagram illustrating an internal configuration of the housing. FIG. 5 is a cross-sectional diagram in which a part depicted by a dashed-dotted line in FIG. 3A is cut away at an X'-Z plane. The main body part has the hollow part 2*a* inside which the speaker 4 is accommodated with a sound-emitting direction directed to a +Z direction. The main body part also causes the hollow part 2*a* to continue to the hollow part of the sound guide tube 3 and supports the base end thereof to a front side.

The speaker 4 is supported by a support (not illustrated) provided on the head 2*c*.

It is to be noted that a vent hole 2*b*0 is preferably provided on side of the sound guide tube 3 rather than the speaker 4 in the main body (or the sound guide tube 3). A space that is closed by the housing 2, the sound guide tube 3, the external acoustic opening 8, and the drum membrane is formed. In that case, characteristics of sounds to be transmitted in this space may vary. Such a change in the characteristics is to be prevented. In the example, the vent hole 2*b*0 is equipped on the inclined surface 2*b*.

The earphone may further include the vent hole 2*b*0 that opens to the inclined surface 2*b*, and includes, in the hollow part 2*a*, a valve and an elastic member 6 such as a spring or the like, the valve opening or closing the vent hole 2*b*0 and the elastic member 6 adjusting opening or closing of the valve. As a result, it is possible to adjust the sound quality according to user's preference, by opening or closing the valve by means of the elastic member 6.

Because the housing 2 has the inclined surface 2*b* on the outer surface, it is possible to wear the earphone 1 on the ear by inserting the housing 2 into the cavum conchae with an end of the X' side and an end of the −X' side of the housing 2 directed to the antitragus (and the antihelix) and the tragus, respectively, thereby inserting the sound guide tube 3 into the external acoustic opening, and supporting the inclined surface 2*b* by the inner surface of the cavum conchae. This allows the fit to be given.

As described above in detail, by devising a shape of the housing 2, the earphone 1 of the example has a large speaker disposed close to the sound guide tube with the axial direction of the sound guide tube aligned with the sound-emitting direction of the speaker.

INDUSTRIAL APPLICABILITY

An earphone that achieves good sound quality by disposing a large speaker close to a sound guide tube, with an axial direction of the sound guide tube aligned with a sound-emitting direction of a speaker. Use by many earphone producers is expected.

DESCRIPTION OF REFERENCE NUMERALS

1 Earphone
2 Housing
2*a* Hollow part
2*b* Inclined surface
2*b*0 Vent hole
2*c* Head
3 Sound guide tube
4 Speaker
5 Cord holder unit
5*a* Cord
6 Elastic member
7 Ear
7*a* Tragus
7*b* Cavum conchae
7*c* Scapha
8 External acoustic opening

The invention claimed is:

1. An earphone comprising:

a speaker that outputs sounds to a uniaxial direction;

a sound guide tube that is offset from a center of the speaker to and disposed on one side of a direction orthogonal to the uniaxial direction, the sound guide tube extending to a direction parallel to the uniaxial direction; and a housing that accommodates the speaker and supports a base end of the sound guide tube, wherein the housing is broadened from the base end to other side opposite to the one side, toward a location where the speaker is accommodated, and has an inclined surface that inclines at the broadened location, and a separation distance between a central axis of the speaker and a central axis of the sound guide tube is smaller than an internal radius of the sound guide tube.

2. The earphone according to claim 1, wherein the inclined surface inclines at an angle of 25 to 35 degrees to the uniaxial direction, to a direction toward the other side, of the orthogonal directions, and is formed in a recessed shape.

3. The earphone according to claim 1, wherein the housing has an oval shape with a direction orthogonal to the uniaxial direction as a long axis direction when it is seen from one side to other side of the uniaxial direction.

4. The earphone according to claim 1, wherein at least one of the housing or the sound guide tube has a vent hole on side of the sound guide tube rather than on the speaker.

5. The earphone according to claim 1, wherein the earphone further includes a valve that opens or closes the vent hole and an elastic member that adjusts opening or closing of the valve.

* * * * *